US005375930A

United States Patent [19]

Tani

[11] Patent Number: 5,375,930

[45] Date of Patent: Dec. 27, 1994

[54] EASILY OPENABLE SYNTHETIC RESIN BAG

[76] Inventor: Kanari Tani, 70, Minamigaoka 4-chome, Ohnojo-shi, Fukuoka, Japan

[21] Appl. No.: 111,349

[22] Filed: Aug. 24, 1993

[30] Foreign Application Priority Data

Mar. 30, 1993 [JP] Japan ..... 5-072385

[51] Int. Cl.[5] ..... B65D 30/10

[52] U.S. Cl. ..... 383/206; 383/104; 383/907

[58] Field of Search ..... 383/104, 122, 907, 205, 383/206

[56] References Cited

U.S. PATENT DOCUMENTS

| | | | |
|---|---|---|---|
| 3,057,539 | 10/1962 | Leary, Jr. | 383/206 |
| 3,246,833 | 4/1966 | Schlienz et al. | 383/206 |
| 3,380,646 | 4/1968 | Doyen et al. | 383/104 |
| 3,935,993 | 2/1976 | Doyen et al. | 383/104 X |
| 4,361,235 | 11/1982 | Gautier | 383/104 X |
| 4,650,079 | 3/1987 | Tani | 383/206 |
| 5,116,140 | 5/1992 | Hirashima | 383/206 |

FOREIGN PATENT DOCUMENTS

| | | | |
|---|---|---|---|
| 3925871 | 2/1991 | Germany | 383/104 |
| 0584735 | 11/1958 | Italy | 383/122 |
| 4006044 | 1/1992 | Japan | 383/104 |

*Primary Examiner*—Allan N. Shoap
*Assistant Examiner*—Jes F. Pascua
*Attorney, Agent, or Firm*—Jordan and Hamburg

[57] ABSTRACT

The easily openable synthetic resin bag substantially comprises a) a bag body having in an overlapped state front and rear walls of substantially rectangular shape, and a bottom wall interposed between the lower ends of the front and rear walls and having opposite side edges folded down in an inverted V-shape, and b) a tear string heat sealed on the inner side of the rear wall along an opening line at the upper end of the bag body and having opposite end portions thereof heat sealed in gripped state between corresponding portions of the lateral marginal seal portions of the bag body; the bag body having a width gradually broadened in a tapered fashion from the upper to lower end thereof. Accordingly, when the bag body is packed with a filling material and undergoes reductions in width in bag portions packed with the filling material, such bag portions still have a width which substantially equivalent to or which is not markedly smaller than the width of the unfilled upper bag portions. Therefore, when put on a shelf or a similar support surface, the bag can stand there in a quite stabilized state.

6 Claims, 14 Drawing Sheets

EASILY OPENABLE SYNTHETIC RESIN BAG

BACKGROUND OF INVENTION

This invention relates to a synthetic resin bag which can be easily opened by way of a tear string and which can stand alone in a stable state when put on a shelf in a shop or in home use.

There has thus far been known a synthetic resin bag B as shown in FIGS. 16 to 19, which can keep a stand-up position in a stable state when put on a shelf or a similar support surface in a shop or in home use.

As seen in these figures, the synthetic resin bag B includes a couple of overlapped front and rear walls 50 and 51 and a bottom wall 52 folded in an inverted V-shape and inserted between the lower ends of the front and rear walls 50 and 51. The front and rear walls 50 and 51 are welded to each other by heat sealing in marginal edge portions at each side except the lower side where the marginal edge portions of the front and rear walls 50 and 51 are heat sealed to lower marginal edge portions of the bottom walls 52 to form a bag body 53.

Further, as shown in FIGS. 16 to 19, the bag B is provided with a transverse sealing fastener 54 in a top portion of the bag 53 across the width thereof.

As seen in FIG. 17, the sealing fastener 54 is composed of an elongated female member of U-shape in cross-section which is thermally welded on the inner side of the front wall 50, and an elongated coupling protuberance 56 which is formed on the inner side of the rear wall 51 and which is disengageably engageable with a coupling groove on the part of the female member 55.

The synthetic resin bag B with such an arrangement is folded in a flat shape when in an empty state free of any filling material, as seen in the longitudinal section of FIG. 17.

On the other hand, when the upper end of the synthetic resin bag B is cut off and the sealing fastener 54 is uncoupled to fill a material into a packing space 56 in the bag 53, the bottom wall 52 of inverted V-shape is unfolded and stretched toward the front and rear sides to form a flat bottom as shown in FIG. 19. As a result, a packing space with an ample breadth is formed in the bag 53 so that a large quantity of material can be packed in the bag 53.

Besides, the synthetic resin bag B of the above arrangement has a flat bottom surface of a sufficient breadth when in filled state, as shown in FIG. 19, so that one can put it in a stand-up position on a shelf or on a similar support surface for storage or display or for other purposes.

However, the conventional synthetic resin bag B with the above-described construction still has a number of problems to be solved as discussed below.

Namely, when in an unfilled empty state or in a flatly folded state with one side overlaying on the other as shown in FIG. 16, normally the synthetic resin bag B has a rectangular shape with one and same width W from the upper to lower end thereof in front view.

Therefore, when the bag 53 is packed with a certain quantity of filling material, the bottom wall 52 of inverted V-shape is unfolded and flatly spread toward the front and rear sides and, as shown in FIG. 19, the front and rear walls bulge out toward front and rear sides mainly in the respective center portions except their upper portions where the bag is not packed with the filling material. Consequently, in contrast to the unfilled upper portions which retain the original width W, the packed portions of the bag are deformed to have a narrower width w which is markedly smaller than the width W of the unfilled upper portions. This means that, when the bag is put on a shelf or a similar support surface, it would stand in an extremely unstable state as seen in FIG. 19.

Therefore, at the time of putting such synthetic resin bags B on or off a shelf or the like, it is very likely that the synthetic resin bags B easily fall down when upper portions of adjacent bags come into abutting contact with each other. Visually, such a look gives customers an impression of instability which might impair their buying aspirations.

Further, when placing the synthetic resin bags B side by side on a shelf, the adjacently located bags come into contact with each other firstly in their broader or wider upper portions, leaving wasteful spaces between the lateral sides of the adjacently located bags B and thus limiting the number of the synthetic resin bags B which can be placed on a shelf in terms of an area per unit length.

It is an object of the present invention to provide a synthetic resin bag which can solve the above-mentioned problems.

According to the present invention, there is provided an easily openable synthetic resin bag which is characterized by the provision of: a) a bag body proper having in an overlapped state front and rear walls of substantially rectangular shape, and a bottom wall interposed between the lower ends of the front and rear walls and having opposite side edges folded down in an inverted V-shape, the front and rear walls being thermally welded to each other along lateral and upper marginal edges to form lateral marginal seal portions and an upper marginal seal portion, the front and rear walls having marginal edge portions at the respective lower ends thermally welded to marginal edge portions at the opposite lower ends of the bottom wall to form lower marginal seal portions, and lower end portions of the front and rear walls being thermally welded to lower end portions of the bottom wall forming a pair of corner portions, said corner portions respectively having oblique sealing lines forming triangles between a lower end portion of each lateral marginal seal portion and opposite end portions of the lower marginal seal portions to form obliquely cut seal portions; and b) a tear string heat sealed on the inner side of the rear wall along an opening line at the upper end of the bag body and having opposite end portions thereof heat sealed in gripped state between corresponding portions of the lateral marginal seal portions of the bag body; the bag body having a width gradually broadened in a tapered fashion from the upper to lower end thereof.

In the foregoing bag construction, the present invention has further features as given below.

(1) The bag body is so shaped as to have at the upper end thereof an opening of a width larger than the width between lower ends of obliquely cut seal portions contiguously connected to the lower seal portions, but smaller than the width between the upper ends of the obliquely cut seal portions.

(2) A portion of the left-hand lateral marginal seal portion of the bag body is bulged out to form an ear portion at a position corresponding to the tear string, the ear portion being provided with a pulling tab so arranged as to be peelable from the left-hand lateral marginal seal portion integrally together with one end of the tearing string.

DETAILED DESCRIPTION OF THE PREFERRED EMBODIMENTS

Hereafter, the synthetic resin bag It according to the present invention is described more particularly by way of preferred embodiments shown in the accompanying drawings.

Figure 1:
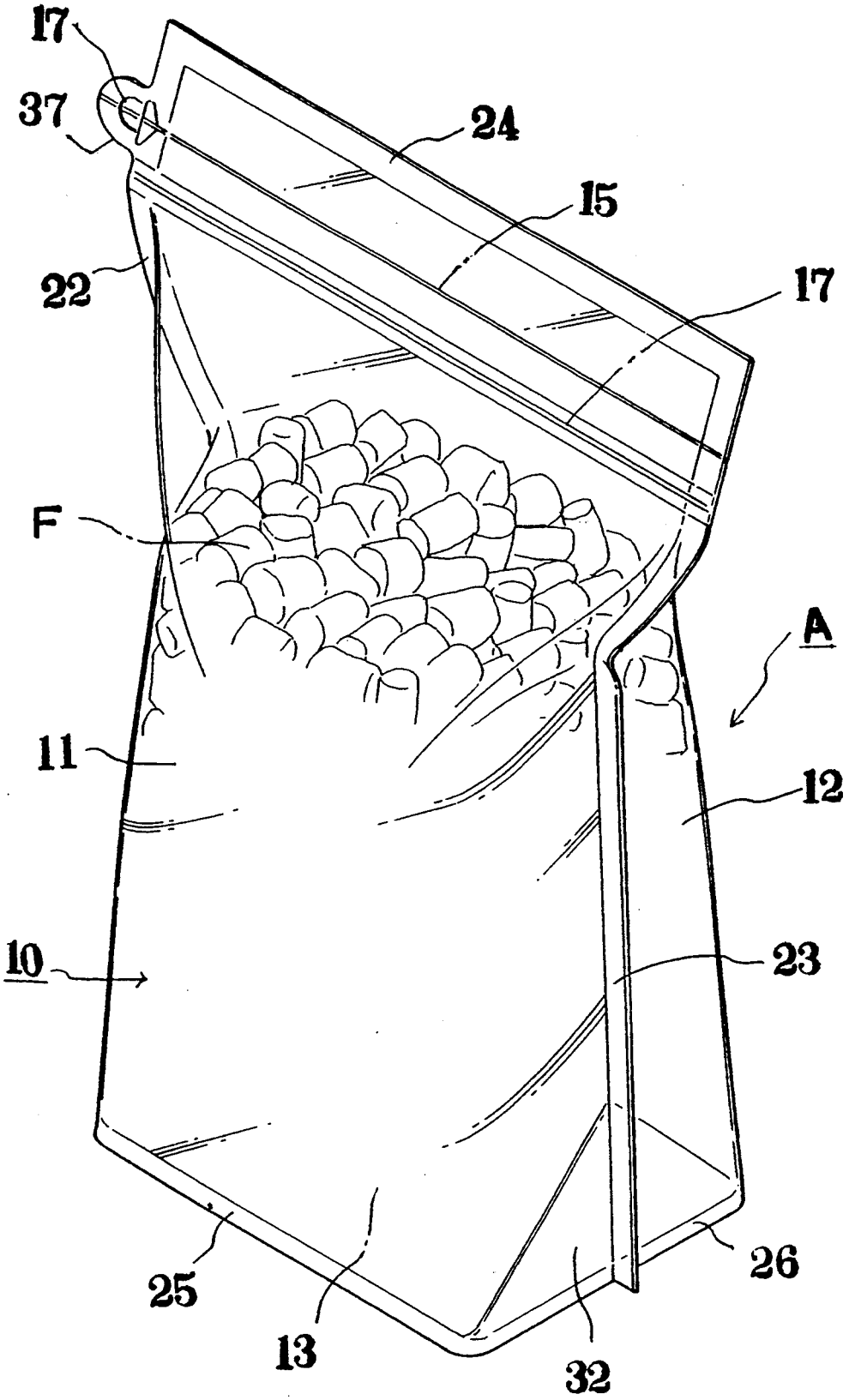
FIG. 1 is a perspective view of a synthetic resin bag according to the present invention, in a filled state.
Figure 7:
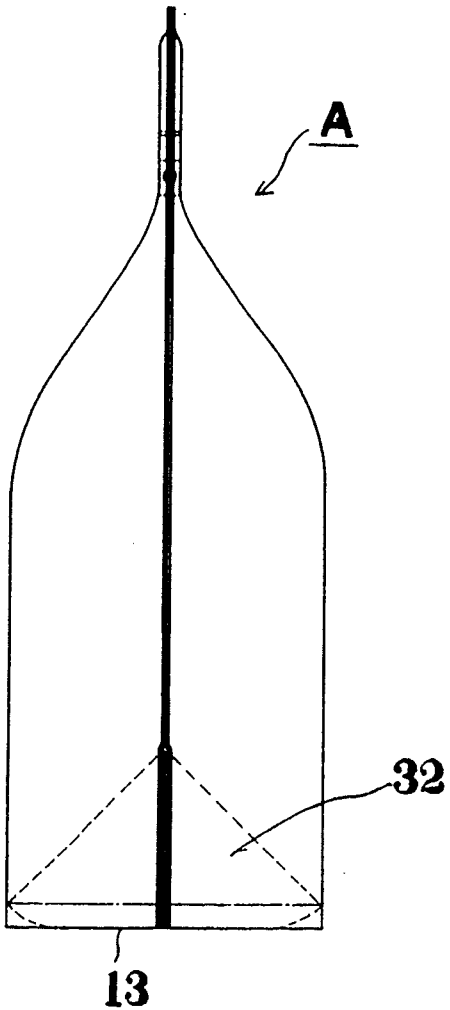
FIG. 7 is a side view of the filled synthetic resin bag.
Figure 8:
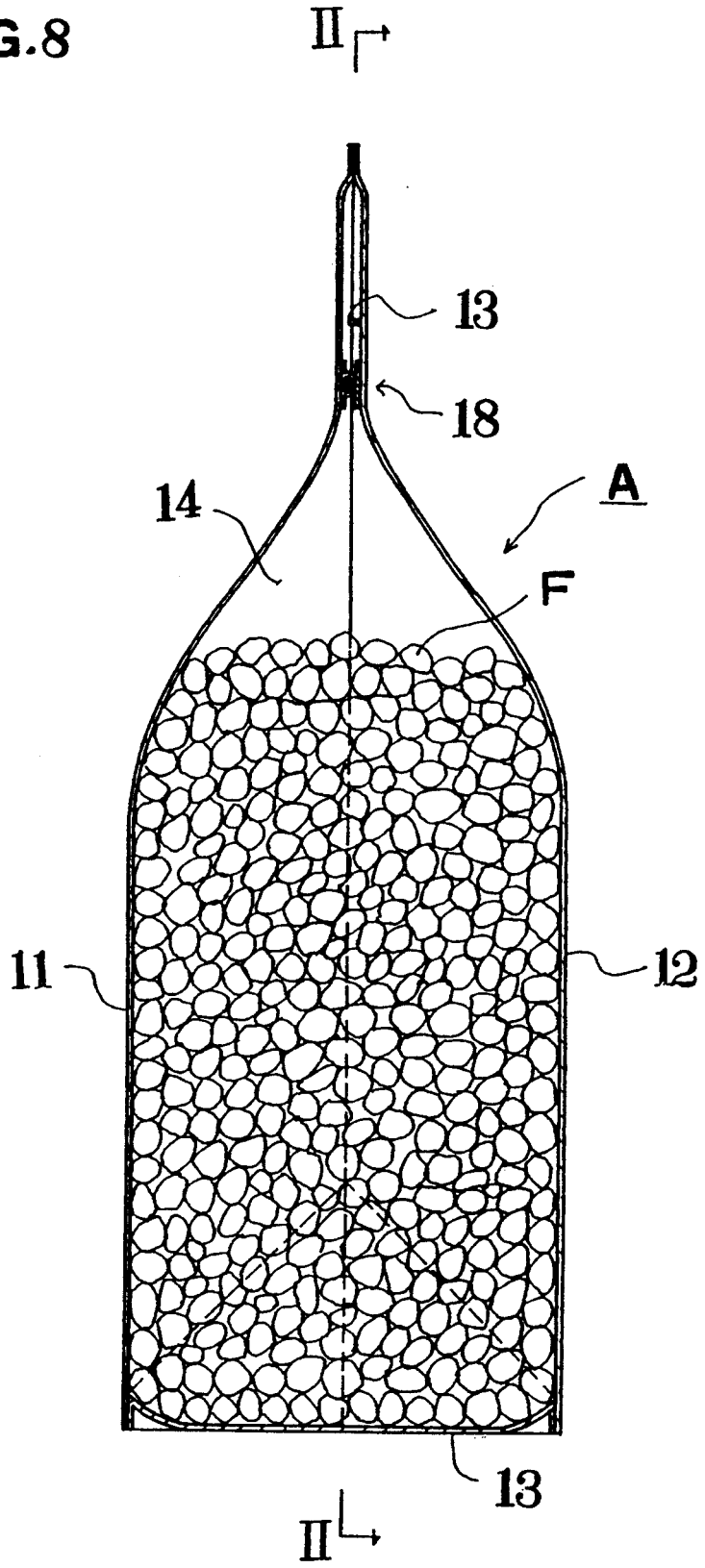
FIG. 8 is a sectioned side view of the filled synthetic resin bag.
Figure 9:
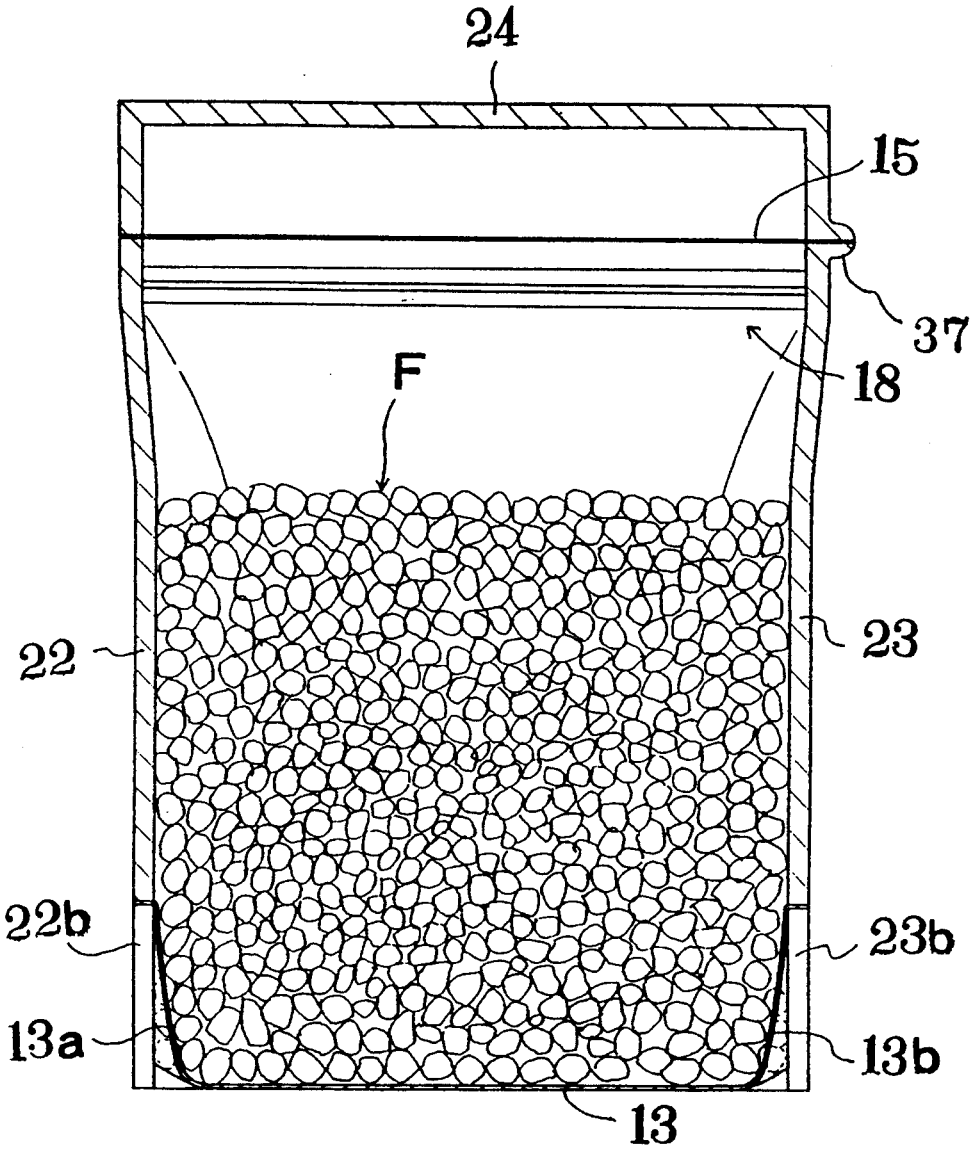
FIG. 9 is a sectioned front view taken on line II—II of FIG. 8.

In FIGS. 1 through 13, indicated at 10 is a synthetic resin bag body proper which is composed of a couple of substantially rectangular front and rear walls 11 and 12 and a single bottom wall 13 of an inverted trapezoidal shape in front view, the front and rear walls being thermally welded to each other and to the bottom wall by heat sealing or other suitable means along marginal edge portions substantially on all sides of the front and rear walls to maintain the bag in a sealed state. As shown in FIGS. 1, 8 and 9, in a charged or packed state, the synthetic resin bag 10 is unfolded to provide interiorly a packing space 14 for holding a filling material F such as dried fruit or the like.

Figure 3:
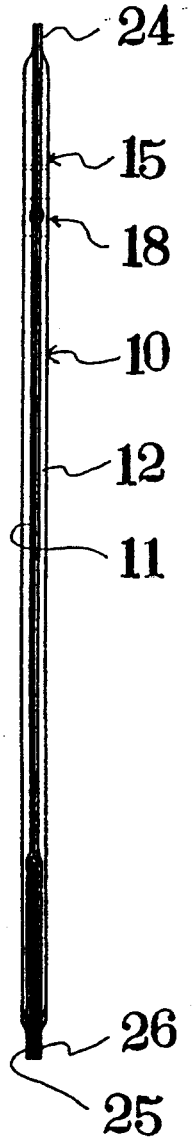
FIG. 3 is a side view of the synthetic resin bag.
Figure 5:
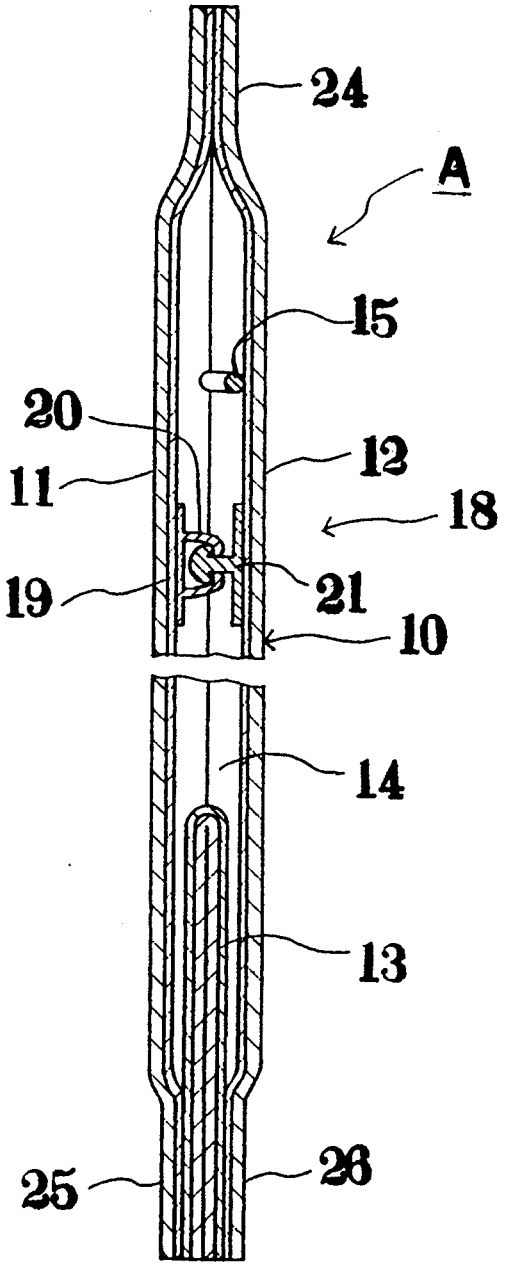
FIG. 5 is a sectioned side view on an enlarged scale of the same synthetic resin bag.

As shown in FIGS. 1, 3 and 5, the bag body 10 proper has a tearing string 15 thermally welded on the inner side of an upper portion of the rear wall 12 which forms a straight tubular portion 10*a* at the upper end of the bag body 10. The tear string 15 is extended transversely across the width of the bag body 10, and has its opposite ends terminated at the outer edges of lateral marginal seal portions 22 and 23 of the bag body, respectively.

Further, a pulling tab 17 is connected to one end of the tear string 15, so that, as the pulling tab 17 is pulled together with the tear string 15, the rear wall 12 is torn apart to open the upper end of the bag A.

Figure 2:
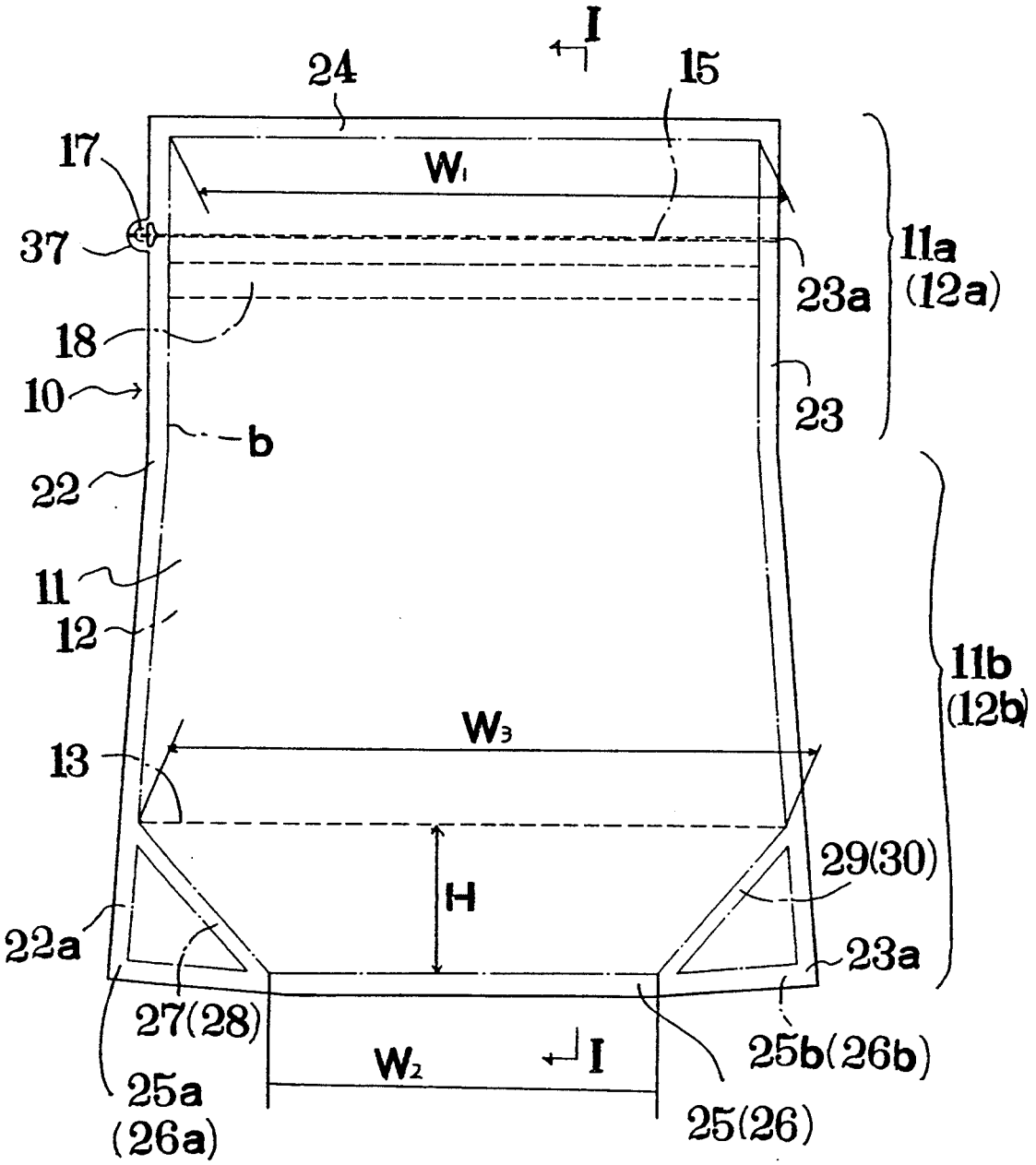
FIG. 2 is a front view of the synthetic resin bag in an unfilled or empty state.

Besides, as shown in FIGS. 1 and 2, the bag body 10 is provided with a transversely extending sealing fastener 18 under the tear string 15 in parallel relation therewith.

Figure 4:
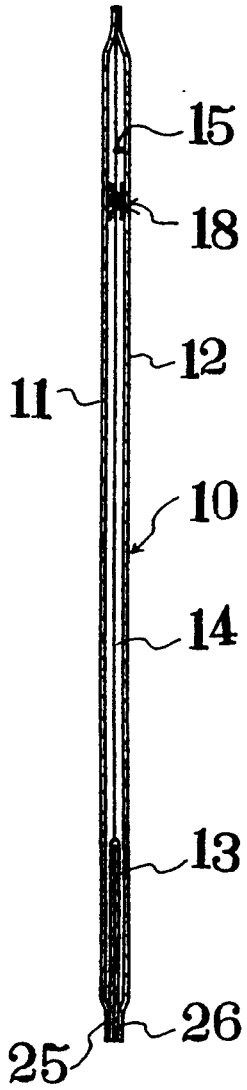
FIG. 4 is a sectioned side view taken on line I—I of FIG. 2.

As shown in FIGS. 4 and 5, the sealing fastener 18 is composed of an elongated female member 19 which is formed in U-shape in cross-section and thermally welded on the inner surface of the front wall 11, and an elongated ridge or protuberance 21 which is provided on the inner surface of the rear wall 12 to disengageably engage with a coupling groove 20 of the female member 19.

With this arrangement, after tearing off an upper portion of the bag body 10 by the tear string 15 and releasing the sealing engagement of the coupling groove 20 with the coupling protuberance 21 to take out part of the filling material F or the content of the bag 10, the coupling groove 20 and protuberance 21 can be engaged with each other again to reinstate the sealed state for the purpose of keeping freshness of the filling material F for as long a time period as possible.

A feature of the present invention resides in that, in the synthetic resin bag A of the above-described construction, the bag body 10 is formed substantially in a trapezoidal shape in front view.

More specifically, as shown in FIG. 2, the front and rear walls 10 and 11 of the bag body 10 are constituted by upper straight portions 11*a* and 12*a* and downwardly diverging lower tapered portions 11*b* and 12*b*, respectively, the lower tapered portions having a width downwardly increasing from the respective upper ends contiguously connected to the lower terminal ends of the upper straight portions 11*a* and 12*a*.

The bag body 10 has the bottom wall 13 of an inverted V-shape inserted between lower end portions of the paired substantially trapezoidal front and rear walls 11 and 12 which are in overlapped relation with each other. The front and rear walls 11 and 12 are thermally welded or heat sealed in marginal edge portions along all sides except their lower marginal edges to form lateral marginal seal portions 22 and 23 and an upper marginal seal portion 24. The lower marginal edge portions of the front and rear walls 11 and 12 are heat sealed to corresponding lower marginal edges of the bottom wall 20 to form a pair of lower marginal seal portions 25 and 26. The lower marginal seal portions 25 and 26 are not heat sealed integrally to each other, because the bottom wall 13, which is folded in an inverted V-shape with a wall section of an inverted trapezoidal shape on each side, is spread into a flat rectangular form as will be described hereinlater.

Further, lower end portions of the front and rear walls 11 and 12 are heat sealed to corresponding lower end portions of the bottom wall 20 along a line connecting a point located upward of the lower edge 22*a* or 23*a* of the lateral marginal seal portion 22 or 23 by a distance corresponding to the height H of the folded bottom wall 13 and a point located inward of the side edge 25*a* or 25*b* (26*a* or 26*b*) of the lower marginal seal portion 25 (26) by a distance substantially equal to the height H. However, similarly to the lower marginal seal portions 25 and 26, the obliquely seal portions 27 and 28 at one lateral side of the bag as well as the obliquely seal portions 29 and 30 at the other lateral side of the bag are not heat sealed to each other in order to spread the inverted trapezoidal bottom wall sections into a flat rectangular shape from the folded inverted V-shape as will be described hereinlater.

Preferably, as shown in FIG. 5, the front and rear walls 11 and 12 and the bottom wall 13 are each formed by laminating a necessary number of synthetic resin films. The peripheral edges of the front and rear walls 11 and 12 are heat sealed to each other and to meeting peripheral edges of the bottom wall 13 by the use of a heat seal bar or the like with application of pressure to form the bag body 10 which interiorly has a sealed packing space 14.

in FIG. 2, the reference character b indicates a boundary line of the packing space 12 along the marginal seal portions 22, 23 and 24.

As seen in FIGS. 2 to 5, the synthetic resin bag A, with the above-described construction according to the present invention, is folded in a flat shape in side view or in section before it is packed with the filling material F. In front view, the bag has a trapezoidal shape with a width gradually increasing from its upper end to its lower portions in a tapered fashion.

Figure 10:
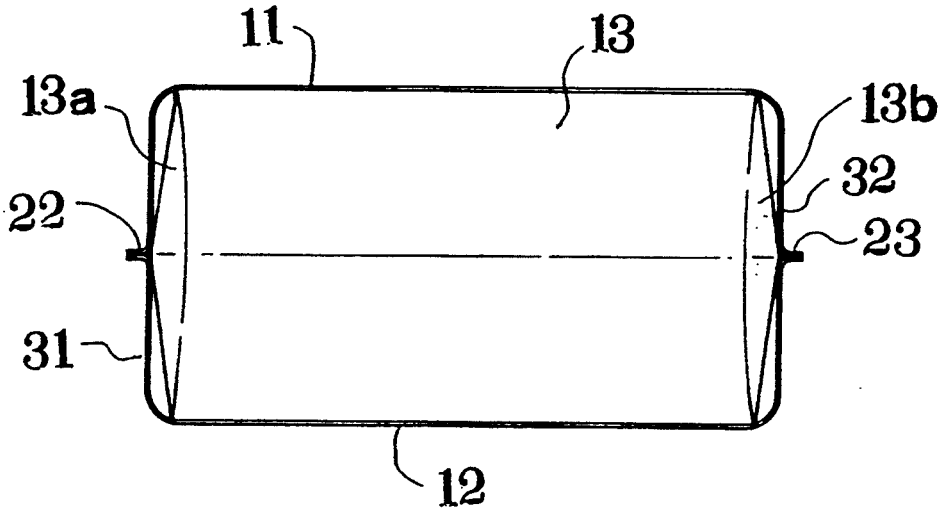
FIG. 10 is a bottom view of the same bag.

On the other hand, when packed with the filling material F, the inverted trapezoidal bottom wall sections, which are folded in inverted V-shape, are spread toward the front and rear sides into a flat rectangular shape as shown in FIGS. 1 and 10. Consequently, as shown in FIGS. 8 and 9, a packing space 14 of an ample breadth is formed within the bag body 10 to accommodate an ample amount of filling material F.

Besides, as shown in FIGS. 1 and 10, the bottom wall 13 of the bag body 10 is stretched toward the front and rear sides into a rectangular shape with a suitable breadth to secure a sufficient contacting area for the bag body 10 to stand alone stably on a shelf or the like, providing great convenience at the time of storage or display of the bag.

Figure 6:
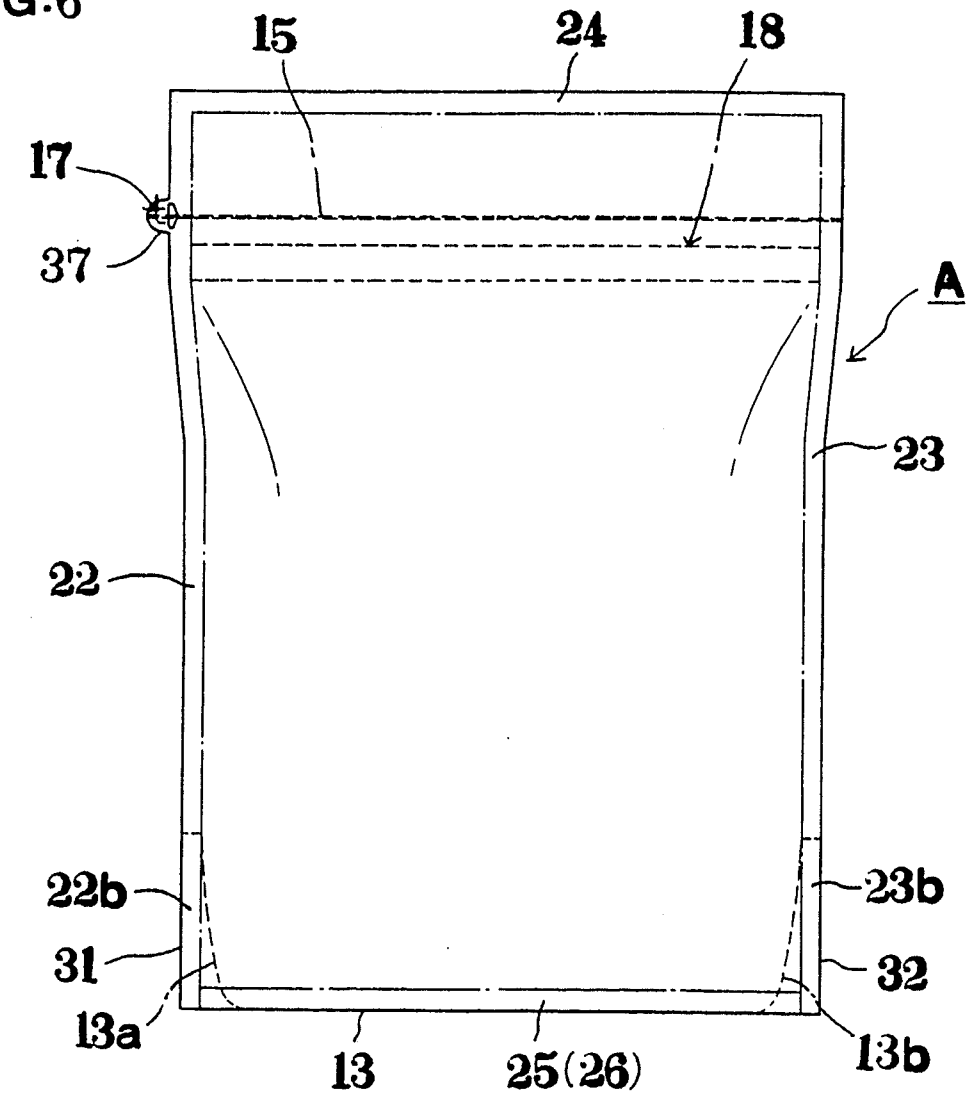
FIG. 6 is a front view of the synthetic resin bag in a filled state.

Moreover, when the bag body 10 is packed with a certain amount of filling material F, in addition to the transformation of the bottom wall 13 from a folded inverted-V shape to a flat rectangular shape by stretching in the forward and backward directions, the front and rear walls are bulged out in the forward and rearward directions mainly in center portions thereof, except upper portions where the bag is not packed with the filling material F, as seen in FIG. 1. Consequently, as shown in FIGS. 1, 6 and 7, while the upper bag portions which are not packed with the filling material F maintain the same width, the bag undergoes reductions in width in other portions packed with the filling material F.

In this regard, however, as mentioned hereinbefore, when the synthetic resin bag A is in an empty or unfilled state, namely, in a flat state in side view as shown in FIG. 2, it has a width which gradually increases in a tapered fashion from its upper to lower end in front view. Therefore, when the bag body 10 is packed with a filling material F, despite the reductions in width of the bag portions deformed by the packed filling material F, the width of these bag portions becomes substantially same as that of upper portions of the bag body 10 without undergoing an extremely large reduction in width as compared with the latter.

Accordingly, when placed on a shelf or the like, the bag body 10 can be kept there in an extremely stable state.

It follows that, when putting the synthetic resin bags A on or off a shelf, there is almost no possibility of the adjacently located synthetic resin bags A coming into abutting engagement with each other only at their upper or shoulder portions. Namely, the synthetic bags A can be put on a shelf in such a manner that they contact adjacent synthetic resin bags uniformly along the lengths of their lateral side edges to prevent them from falling down or falling off the shelf.

Further, as illustrated in FIG. 1, the synthetic resin bag A according to the present invention visually gives an impression of stability to customers, and thus contributes to encourage their buying desires.

In addition, the synthetic resin bags A which are adjacently located on a shelf can be held in intimate contact with each other along the entire lengths of their lateral marginal edges without leaving wasteful spaces between lateral sides of the adjacent synthetic resin bags A, permitting to place an increased number of synthetic resin bags A on a shelf in terms of an area per unit length.

Especially in the case of this embodiment, the obliquely cut seal portions 27, 28, 29 and 30 are held in predetermined dimensional relations with regard to the values discussed below.

Namely, the inside width W1 of the upper opening of the bag body 10, the width W2 between the lower ends of the obliquely cut seal portions 27 and 29 (or 28 and 30), and the width W3 between the upper ends of the obliquely cut seal portions 27 and 29 (28 and 30) are in the relations of $W2 < W1 > W3$.

In case the widths at different portions of the synthetic resin bag A are set in such relations, the shape of the synthetic resin bag A changes into a stable box-like form when packed with the filling material A, as shown in FIGS. 1 and 6.

In this particular embodiment, as shown in FIGS. 1, 6, 9 and 10, the wall sections between the obliquely cut seal portions 27 and 28 and between 29 and 30 form upright walls 13*a* and 13*b* in the shape of an equilateral triangle when the filling material F is packed into the synthetic resin bag A.

However, in this particular embodiment, lower end portions the front and rear walls 11 and 12, on the opposite sides of lower end portions 22*b* and 23*b* of the lateral marginal sealed portions 22 and 23, form skirt portions 31 and 32 to conceal the upright wall portions 13*a* and 13*b* which might otherwise impair the appearance of the synthetic resin bag A. Besides, a desired print may be put on the skirt portions 31 and 32.

Figure 11:
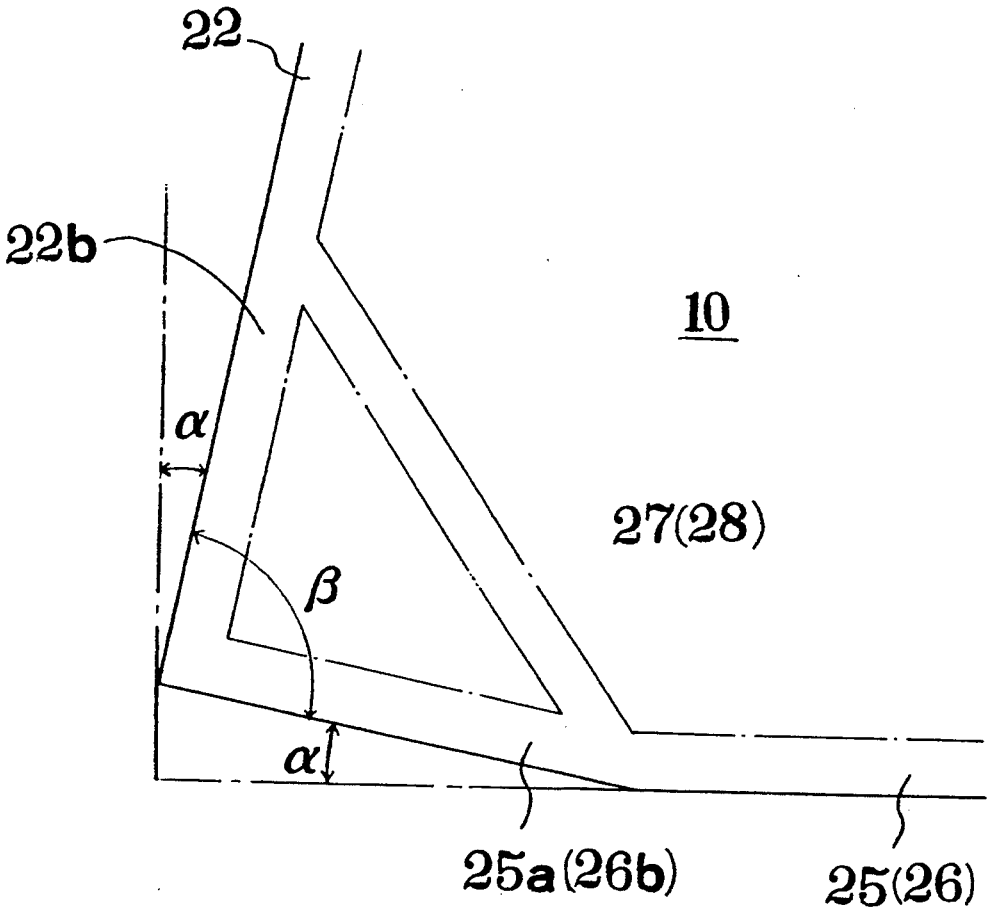
FIG. 11 is an enlarged fragmentary front view of a lower portion of the bag body.
Figure 13:
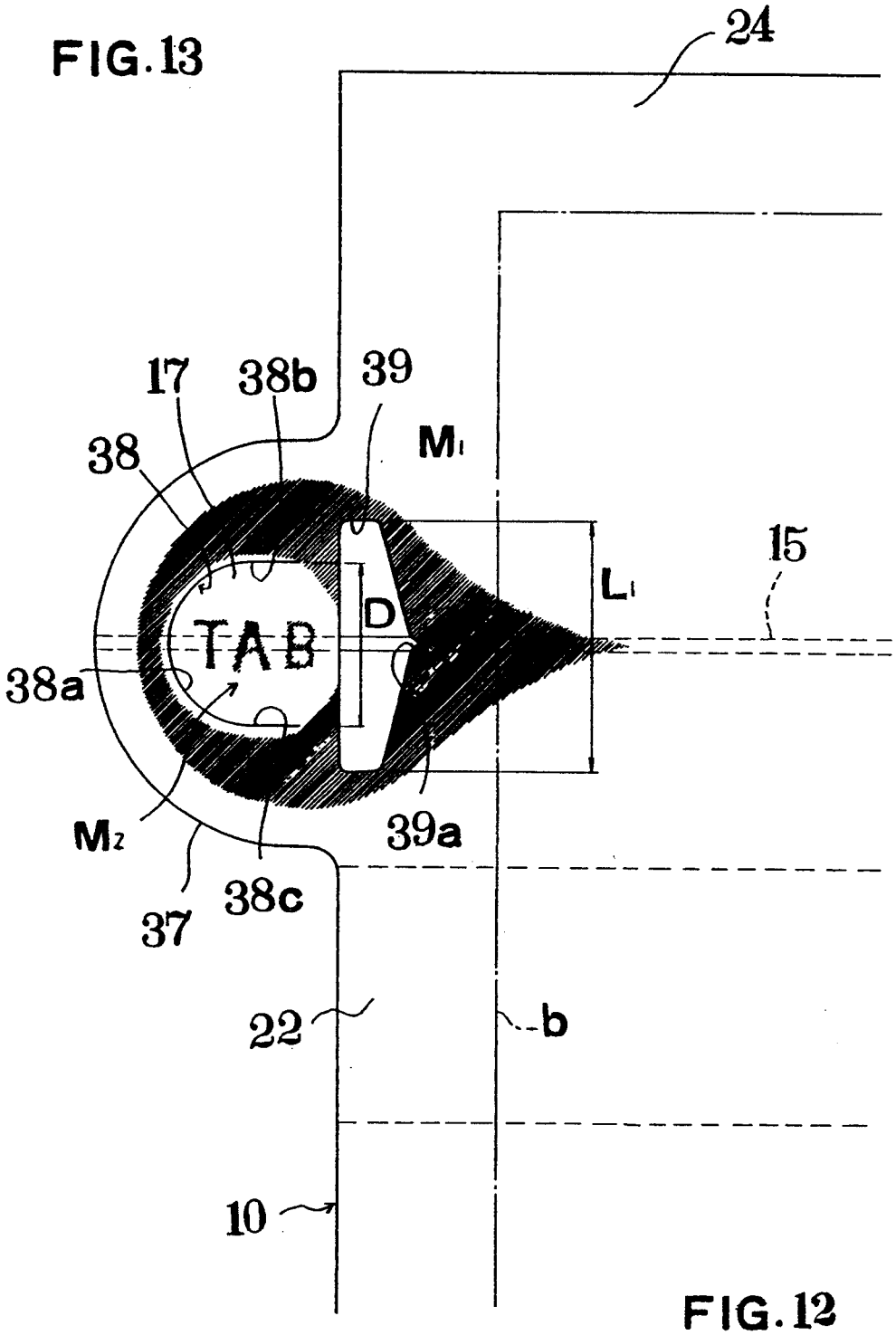
FIG. 13 is an enlarged fragmentary front view of a bag portion formed with a pulling tab.

Further, as shown in FIG. 11, the lower end portions 22*b* and 23*b* of the lateral marginal seal portions 22 and 23, which form part of the skirt portions 31 and 32, are held in the following relations with the opposite lateral end portions 25*a*, 26*a*, 25*b* and 26*b* of the lower marginal seal portions 25 and 26.

Namely, the lower end portions 22*b* and 23*b* of the lateral marginal seal portions 22 and 23 are so shaped as to have a certain taper angle before the filling material F is packed into the bag body 10, as shown in FIG. 11. On the other hand, the opposite lateral end portions 25*a*, 26*a*, 25*b* and 26*b* of the lower marginal seal portions 25 and 26 are tapered with the same angle $\alpha$ so that they form an angle $\beta$ of approximately 90° with the lower end portion 22*b* or 23*b* of the lateral marginal seal portion 22 or 23.

Accordingly, as shown in FIGS. 1 and 6, when packed with the filling material F, the lower end portions 22*b* and 23*b* of the lateral marginal seal portions 22 and 23 of the bag body 10 are disposed vertically to a support surface of a shelf or the like. At the same time, the opposite lateral end portions 25*a* and 26*a* of the lower marginal seal portions 25 and 26 as well as lower edge portions of the skirt portions 31 and 32 are abutted against the support surface of the shelf to assist the synthetic resin bag A stand stably and neatly on the shelf or other support surface.

Discussed below are other features in construction of the above-described embodiment.

Figure 12:
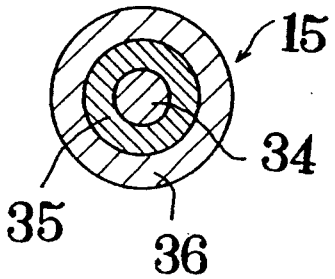
FIG. 12 is a sectional view of a tear string.

As illustrated in FIG. 12, in this embodiment, the tear string is of a concentric triplicate layer construction consisting of a center core string 34, an intermediate adhesive layer 35 and an outer heat sealable or heat fusing layer 36 which is securely bonded to the core string 34 by the intermediate adhesive layer 35.

The core string 34 is preferred to be of polyester and to have a circular shape in section. However, the core string 34 may be of an elliptic, polygonal or other shape in section or may be provided with splines on its outer surface.

The intermediate adhesive layer 35 is formed by coating neoprene on the core string 34.

However, if desired, the intermediate adhesive layer 35 may be made of nitrile rubber or epoxy-polyamide.

Preferably, the outer heat sealable layer is formed of polypropylene in concentric relation with the intermediate adhesive layer 35. However, if desired, there may be employed polypropylene or a copolymer of ethylene and propylene for the outer heat sealable layer 36.

The tear string with the above-described triplicate layer construction can be securely welded on the inner surface of the rear wall 12 of the bag body 10 by heat fusing the outer heat sealable layer 36 along the entire length thereof.

However, the tear string 15 is not necessarily required to have a triplicate layer construction and may be of a single layer construction if desired.

Now reference is had to FIGS. 2 and 12 to explain in greater detail the pulling tab 17 which is formed at the left-hand lateral marginal seal portion 22 where one end of the tear string 15 is terminated.

The pulling tab 17 is substantially constituted by an ear portion 37 of a semi-circular shape which is projected outward of an outer edge portion of the left-hand marginal seal portion 22, a U-shaped slit 38 formed in a position inwardly spaced from the outer end of the ear portion 37, and a transverse opening 39 formed at a position adjacent to the slit 38 and on the inner side of the bag body 10.

The slit 38 includes a circular cut 38*a* which is formed in a spaced position from the outer edge of the left-hand lateral marginal seal portion 22, and a pair of side cuts 38*b* and 38*c* which are formed symmetrically on the opposite sides of the tear string 15.

The inner ends of the side cuts 38*b* and 38*c* are in a straight from or slightly inclined toward the tear string 15 to ensure that the side cuts 38*b* and 38*c* be smoothly connected to the transverse opening 39 when the pulling tab 17 is pulled.

As shown particularly in FIG. 12, the transverse opening 39 is extended across the tear string 15 at a position between the inner side of the bag body 10 and the inner ends of the side cuts 38*b* and 38*c* of the slit 38. The tear string 15 is passed through a center portion of the transverse opening 39.

The transverse opening 39 has a length L1 across the tear string 15. This length L1 is greater than the distance D between the inner ends of the side cuts 38*b* and 38*c* of the slit 38, so that, when the pulling tab 17 is pulled upward, the inner ends of the side cuts 38*b* and 38*c* are invariably caused to reach the transverse opening 39.

Moreover, the transverse opening 39 is provided with an inner converging end 39*a* which closely approaches the inside of the bag body 10 on and along the tear string 15. This converging inner end 39*a* forms an angle of smaller than 90° with the tear string 15 when measured from the open end in a direction inward of the bag body 10. With the above-described construction, the tear string 15 can always be guided across the transverse opening 39. The end of the tear string 15 is connected to the pulling tab 17, and gripped between the front and rear walls 11 and 12 at the marginal seal portion 22.

Further, in this embodiment, a color mark M1, of a color different from that of the bag body 10, is provided around the peripheral edges of the pulling tab 17, which pulling tab itself bears a tab indicator mark M2 "TAB" on the inner side of the color mark M1, as shown in FIG. 12.

The color mark M1 may be of any color as long as it is clearly contrastive to the color of the bag body A.

Due to the provision of the above-described color mark M1 and the pulling tab indicator mark M2, one can readily recognize the position of the pulling tab 17 as well as the pulling direction of the tab 17 or the tearing direction of the tear string 15, to tear open the bag quite smoothly.

Further, as shown in FIG. 12, the pulling tab 17 is provided on the semi-circular ear portion 37 which is projected outward of the outer edge of the left-hand lateral marginal seal portion 22, so that the boundary line b between the marginal seal portion 14 and the packing space 12 can be in the form of a straight line along the entire length thereof in the upper portion of the bag body 10 without bulging in the inward direction, ensuring smooth charging and discharging of the filling material F into and out of the packing space 14 of the bag body 10.

The synthetic resin bag A according to the present invention can be manufactured on an automatic production line. In such a case, the side edges of the trapezoidal front and rear walls 11 and 12 of the bag body 10 can be shaped by the use of an ordinary cutter or by a punching operation. In the case of a punching operation using a thin flexible blade, the side edges of the bag can be formed in a straight shape or in an arbitrary curved shape to make the synthetic resin bag A as a whole into a desired shape which is stable and yet can meet the taste of users.

Figure 14:
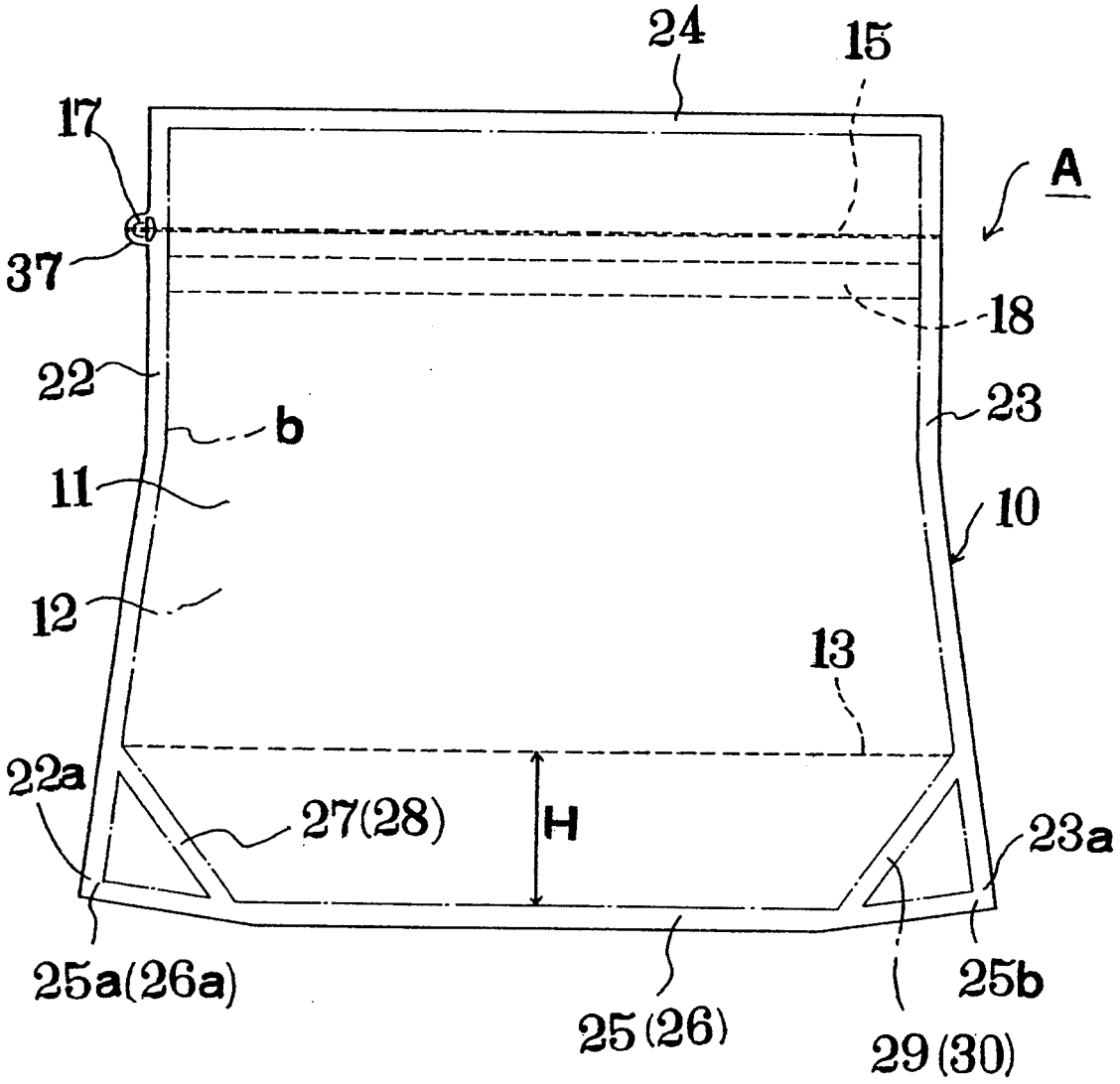
FIG. 14 is a front view of a modification of the synthetic resin bag according to the invention.
Figure 15:
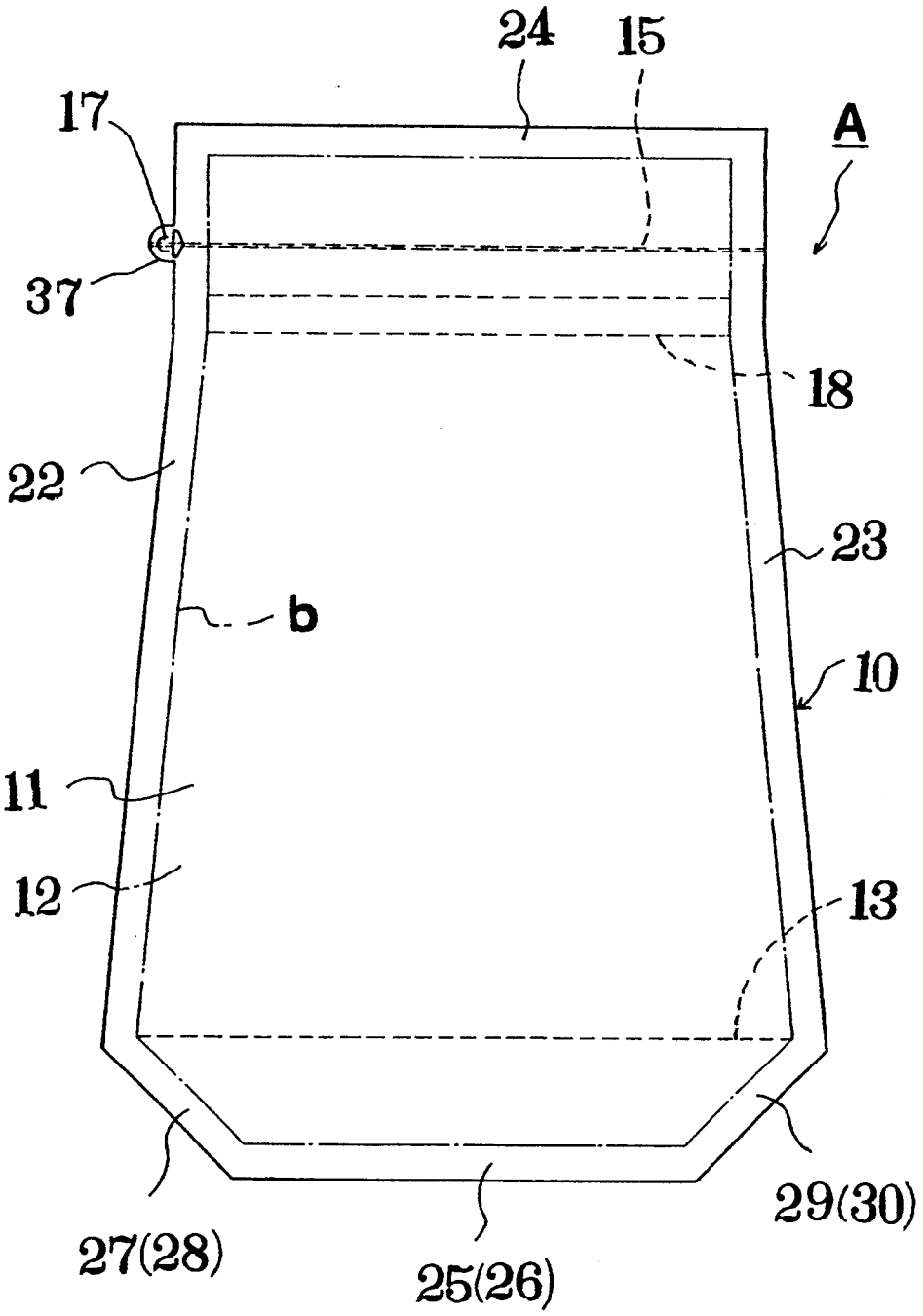
FIG. 15 is a front view of another modification of the synthetic resin bag according to the invention.
Figure 18:
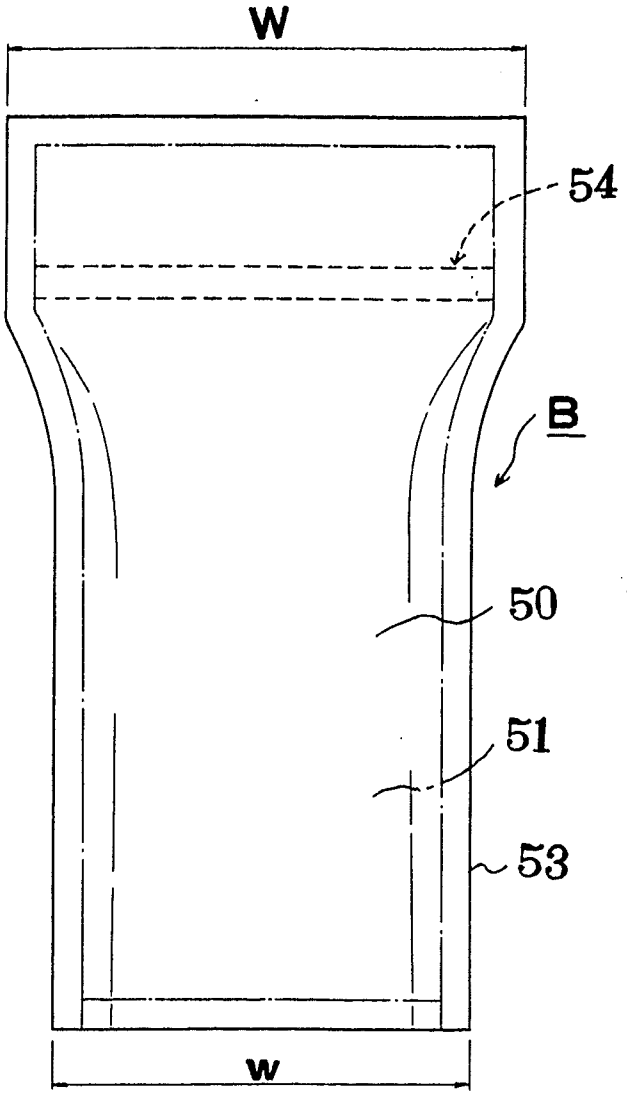
FIG. 18 is a front view of the same synthetic resin bag in a filled state.
Figure 16:
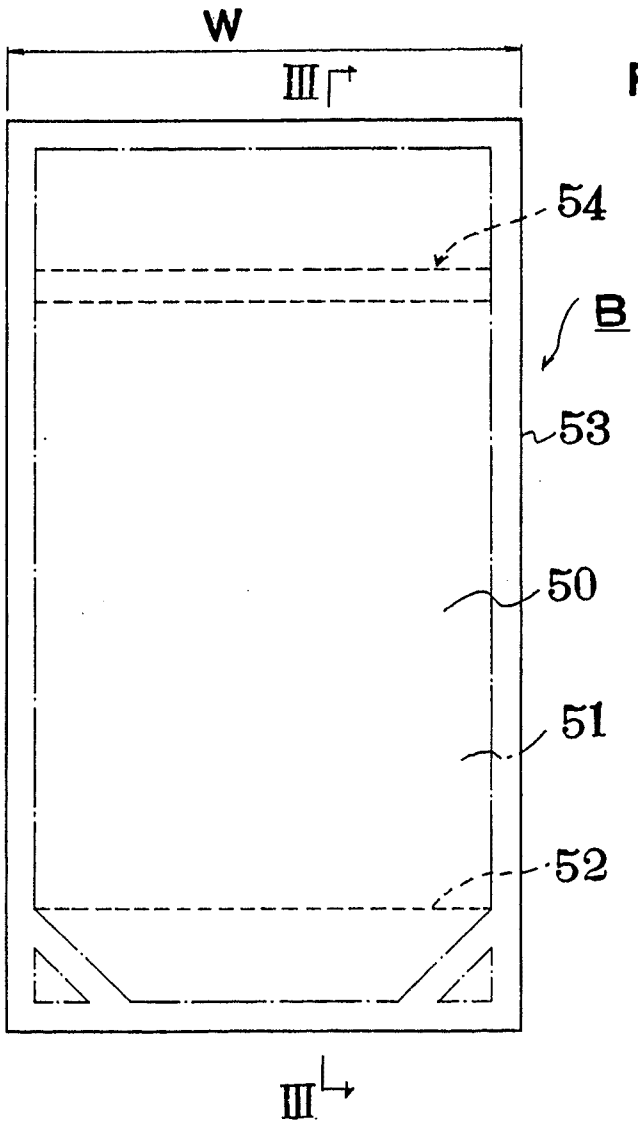
FIG. 16 is a front view of a conventional synthetic resin bag in an unfilled empty state.
Figure 17:
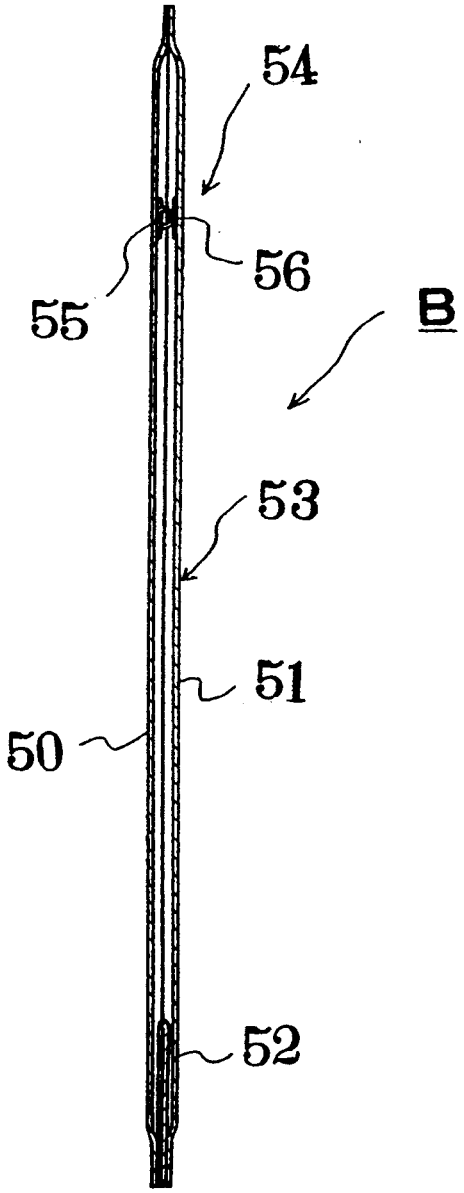
FIG. 17 is a sectional view taken on line III—III of FIG. 16.
Figure 19:
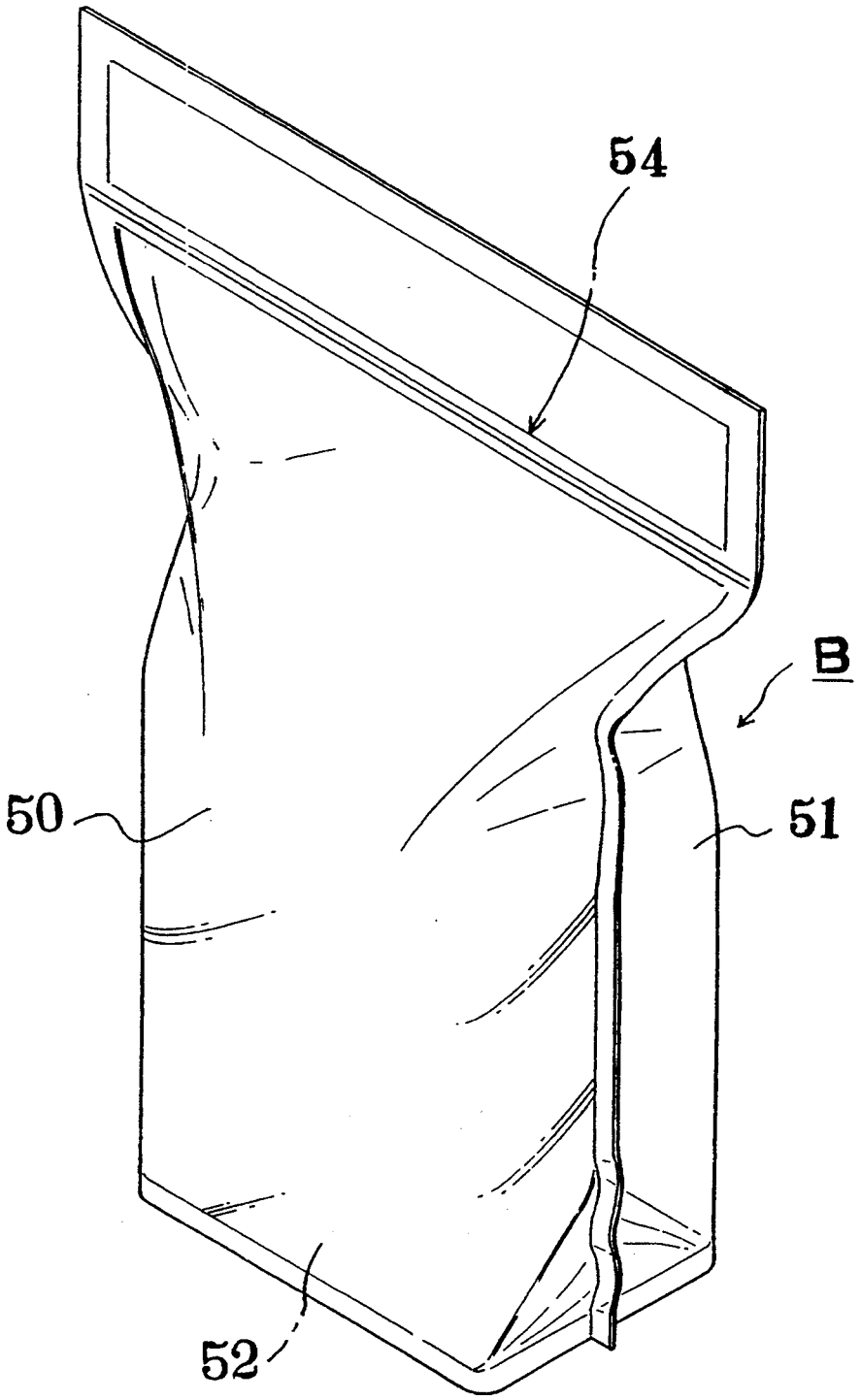
FIG. 19 is a perspective view of the same synthetic resin bag in a filled state.

Illustrated in FIGS. 14 and 15 are modifications of the above-described synthetic resin bag A of the invention. The modification of FIG. 14 is directed to a wide bag construction, while the modification of FIG. 15 is directed to a bag construction dispensing with the skirt portions 31 and 32. Namely, these modifications are inferior in appearance to the synthetic resin bag A of FIGS. 1 through 13 but superior to the latter in facility of production.

As clear from the foregoing description, the easily openable synthetic resin bag according to the present invention is characterized by the provision of: a) a bag body having in an overlapped state front and rear walls of substantially rectangular shape, and a bottom wall interposed between the lower ends of the front and rear walls and having opposite side edges folded down in an inverted V-shape, the front and rear walls being thermally welded to each other along lateral and upper marginal edges to form lateral marginal seal portions and an upper marginal seal portion, the front and rear walls having marginal edge portions at the respective lower ends thermally welded to marginal edge portions at the opposite lower ends of the bottom wall to form lower marginal seal portions, and lower end portions of the front and rear walls being thermally welded to lower end portions of the bottom wall forming a pair of corner portions, the corner portions respectively having oblique seal lines forming triangles between a lower end portion of each lateral marginal seal portion and opposite end portions of the lower marginal seal portions to form obliquely seal portions; and b) a tear string heat sealed on the inner side of the rear wall along an opening line at the upper end of the bag body and having opposite end portions thereof heat sealed in gripped state between corresponding portions of the lateral marginal seal portions of the bag body; the bag body having a width gradually broadened in a tapered fashion from the upper to lower end thereof.

Accordingly, when the bag body is packed with a filling material and undergoes reductions in width in bag portions packed with the filling material, such bag portions still have a width which substantially equivalent to or which is not markedly smaller than the width of the unfilled upper bag portions. Therefore, when put on a shelf or a similar support surface, the bag can stand there in a quite stabilized state. It follows that, when putting similar synthetic resin bags on or off a shelf, they are prevented from abuttingly contacting adjacent synthetic resin bags only at their upper or shoulder portions, namely, they can be held in contact with each other along the entire lengths of their lateral side edges to prevent them from falling down or similar accidents. In addition, the synthetic resin bag according to the present invention can visually give an impression of stability to customers in such a way as to encourage their inclination toward the purchase.

I claim:

1. An easily openable synthetic resin bag comprising:

a) a bag body having, in an overlapped state, front and rear walls and of substantially rectangular shape, and a bottom wall interposed between lower ends of the front and rear walls and having opposite side edges folded down in an inverted V-shape, the front and rear walls being thermally welded to each other along lateral and upper marginal edges to form lateral marginal seal portions and an upper marginal seal portion, the front and rear walls having marginal edge portions at their respective lower ends thermally welded to marginal edge portions at the opposite lower ends of the bottom wall forming a pair of corner portions, said corner portions respectively having oblique seal lines forming triangles between a lower end portion of the lateral marginal seal portion and opposite end portions of the lower marginal seal portions to form obliquely cut seal portions; said bag body having a width gradually broadened in a tapered fashion from an upper to a lower end thereof, wherein a width (W1) of the upper end of said bag body relative to a width (W2) between lower ends of obliquely cut seal portions contiguously connected to the lower marginal seal portions and a width (W3) between upper ends of obliquely cut seal portions is determined by a relationship $W2<W1<W3$; and b) a tear string heat sealed on the inner side of the rear wall along an opening line at the upper end of the bag body and having opposite end portions thereof heat sealed in gripped state between corresponding portions of the lateral marginal seal portions of the bag body; whereby, when the bag body is packed with a filling material, a packed lower portion of the bag body undergoes a reduction in width and the width of the lower portion becomes substantially equal to a width of an unpacked upper portion.

2. An easily openable synthetic resin bag according to claim 1, wherein a portion of the lateral marginal seal portion at a left side of the bag body is protruded outwardly beyond a lateral periphery of the lateral marginal seal portion to form an ear portion at a position corresponding to the tear string, the ear portion being provided with a pulling tab so arranged as to be peelable from the left-hand lateral marginal seal portion integrally together with one end of the tearing string.

3. An easily openable synthetic resin bag according to claim 1, wherein the lower end portions of the lateral marginal seal portions are shaped as to have a tapered angle ($\alpha$) and opposite lateral end portions of the lower marginal seal portions are tapered with the same angle ($\alpha$) so that an angle ($\beta$) of approximately 90° is defined between the lower end portions of the lateral marginal seal portions and the opposite lateral end portions of the lower marginal seal portions.

4. An easily openable synthetic resin bag comprising:

a) a bag body having, in an overlapped state, front and rear walls (11, 12) of substantially rectangular shape, and a bottom wall formed in an inverted trapezoidal shape in side view and having opposite ends of the bottom wall folded down in an inverted V-shape, the front and rear walls being thermally welded to each other along opposite lateral sides and upper sides thereof to form lateral marginal seal portions and an upper marginal seal portion, the front and rear walls having marginal edges at their respective lower ends thermally welded, except opposite lateral ends of the bottom wall, to form lower marginal seal portions, and opposite lateral end portions of lower marginal edges of the front and rear walls being thermally welded to lateral end portions of the bottom wall along symmetric oblique lines;

said bag body having a width gradually broadened in a tapered fashion from an upper end to a lower and thereof, wherein a width (W1) of the upper end of said bag body relative to a width (W2) between lower ends of the obliquely cut seal portions contiguously connected to the lower marginal seal portions and a width (W3) between upper ends of the obliquely cut seal portions is determined by a $W2<W1<W3$; and b) a tear string heat sealed on the inner side of the rear wall along an opening line at the upper end of the bag body, and having opposite end portions thereof heat sealed in gripped state between corresponding portions of the lateral marginal seal portions of the bag body;

whereby, when the bag body is packed with a filling material, a packed lower portion of the bag body undergoes a reduction in width and the width of the lower portion becomes substantially equal to the width of an unpacked upper portion.

5. An easily openable synthetic resin bag comprising:

a) a bag body having front and rear walls of substantially rectangular shape, and a bottom wall interposed between lower ends of the front and rear walls and having opposite side edges folded down in an inverted V-shape, the front and rear walls being thermally welded to each other along lateral and upper marginal edges to form lateral marginal seal portions and an upper marginal seal portion, the front and rear walls having marginal edge portions at their respective lower ends thermally welded to marginal edge portions at the opposite lower ends of the bottom wall forming a pair of corner portions, said corner portions respectively having oblique seal lines forming triangles between a lower end portion of the lateral marginal seal portion and opposite end portions of the lower marginal seal portions to form obliquely cut seal portions; and said bag body having a width gradually broadened in a tapered fashion from an upper to a lower end thereof, wherein a width (W1) of the upper end of said bag body relative to a width (W2) between lower ends of obliquely cut seal portions contiguously connected to the lower marginal seal portions and a width (W3) between upper ends of obliquely cut seal portions is determined by a relationship $W2<W1<W3$;

whereby, when the bag body is packed with a filling material, a packed lower portion of the bag body undergoes a reduction in width and the width of the lower portion becomes substantially equal to a width of an unpacked upper portion.

6. An easily openable synthetic resin bag comprising:

a) a bag body having, in an overlapped state, front and rear walls of substantially rectangular shape, and a bottom wall interposed between lower ends of the front and rear walls and having opposite side edges folded down in an inverted V-shape, the front and rear walls being thermally welded to each other along lateral and upper marginal edges to form lateral marginal seal portions and an upper marginal seal portion, the front and rear walls having marginal edge portions at their respective lower ends thermally welded to marginal edge portions at opposite lower ends of the bottom wall forming a pair of corner portions, said corner portions respectively having oblique seal lines forming triangles between a lower end portion of the lateral marginal seal portion and opposite end portions of lower marginal seal portions to form obliquely cut seal portions, said bag body having a width gradually broadened in a tapered fashion from an upper to a lower end thereof, b) a tear string being heat sealed on an inner side of the rear wall along an opening line at an upper end of the bag body and having opposite end portions thereof heat sealed in a gripped state between corresponding portions of the lateral marginal seal portions of the bag body, and c) a portion of the lateral marginal seal portion at a left side of the bag body being protruded outwardly beyond the lateral periphery of the lateral marginal seal portion to form an ear portion at a position corresponding to the tear string, said ear portion being provided with a pulling tab so arranged as to be peelable from the left-hand lateral marginal seal portion integrally together with one of the tearing string, a boundary line between the marginal seal portion and a packing space formed in a straight line along an entire length thereof in the upper portion of the bag body without protruding inwardly.

* * * * *